United States Patent [19]

Draghetti et al.

[11] Patent Number: 5,022,213

[45] Date of Patent: Jun. 11, 1991

[54] MACHINE FOR WRAPPING SUBSTANTIALLY PARALLELEPIPED COMMODITIES

[75] Inventors: Fiorenzo Draghetti, Medicina; Antonio Gamberini, Bologna, both of Italy

[73] Assignee: G.D. Societa Per Azioni, Bologna, Italy

[21] Appl. No.: 489,050

[22] Filed: Mar. 6, 1990

[30] Foreign Application Priority Data

Mar. 7, 1989 [IT] Italy ..... 3369 A/89

[51] Int. Cl.[5] ..... B65B 11/32

[52] U.S. Cl. ..... 53/234; 53/225

[58] Field of Search ..... 53/148, 225, 234; 198/471.1

[56] References Cited

U.S. PATENT DOCUMENTS

| | | | |
|---|---|---|---|
| 4,079,575 | 3/1978 | Focke et al. | 53/148 X |
| 4,183,191 | 1/1980 | Focke | 53/234 X |
| 4,428,177 | 1/1984 | Focke et al. | 53/234 X |
| 4,909,020 | 3/1990 | Focke | 53/234 X |

*Primary Examiner*—John Sipos

*Attorney, Agent, or Firm*—Cushman, Darby & Cushman

[57] ABSTRACT

The machine is designed to enfold substantially parallelepiped packs in single transparent wrappers and comprises an indexing wheel provided with radial pockets each designed to accommodate one pack together with its wrapper, which is folded to the point where the pack becomes entirely enveloped save for an area of each end face lying at right angles to the axis of the wheel; the wheel includes a pneumatic clamping system whereby suction is applied during the indexed rotation both to the uncovered areas of the pack and to other parts enveloped by the wrapper, in order to disallow movement of the pack internally of the pocket and prevent any relative movement between pack and wrapper.

4 Claims, 2 Drawing Sheets

MACHINE FOR WRAPPING SUBSTANTIALLY PARALLELEPIPED COMMODITIES

BACKGROUND OF THE INVENTION

The invention relates to a machine for wrapping commodities of substantially parallelepiped shape, and in particular, a machine serving to envelop such parallelepiped items in an outer wrapping of transparent material.

The prior art embraces machines for placing an outer wrapping around parallelepiped commodities, especially packs of cigarettes (the case to which the following specification refers); such machines comprise a head, or wheel, rotatable intermittently about a horizontal axis and affording peripheral radial pockets spaced apart one from the next at identical angular distances, each of which designed to accommodate one pack of cigarettes.

The single pocket comprises a bottom wall, nearest the center of the wheel, two substantially radial walls set apart one from the other at a distance essentially matching that of the thickness of one pack, and two end walls embodied generally as two blades lying in planes normal to the axis of the wheel, one on either side, separated by a distance corresponding substantially to the longitudinal dimension of the finished pack.

During each pause produced by intermittent rotation of the wheel, one of the pockets comes to rest at an entry station, in alignment with a reciprocating push rod; stroking forward, the rod engages one pack of cigarettes from the rear flank (considered in relation to the path of entry) and directs it into the waiting pocket together with the wrapper, which consists in a single sheet of material fed through a vertical plane transversely to the path of the entering pack.

On completion of the push rod stroke, the pack will be fully inserted in the pocket with its leading flank flush against the bottom wall.

During the course of this operation, the wrapper is folded gradually into a U shape around the pack, enveloping it on three sides.

The transverse dimension of the wrapper, as seen in relation to the direction of entry, is such that its two sides project a given distance beyond the longitudinal dimension of the pack.

On insertion of the pack into the pocket, these projections will be engaged by the leading edges of the aforementioned blades, and folded in part to envelop a proportion of the two faces of the pack normal to the wheel, i.e. the end faces.

Likewise, the longitudinal dimension of the wrapper is such that, when folded into the U formation, the relative ends project beyond the peripheral limit established by the two radial walls of the pocket. These two projecting ends, or flaps, are folded subsequently, the one by a moving element made to stroke across the entry point, and the other by a fixed element forming part of a cowling coaxial with the wheel, which engages the relative part of the wrapper as the wheel is set in rotation. With the two radial flaps folded and overlapping, and the wrapper enveloping the pack essentially in tubular fashion, the flank of the pack outermost is offered to a heat-seal device located at a further station subsequently to be occupied by the indexing pocket, and the flaps are fused together.

With the pack enveloped thus far by the transparent wrapper and entirely encompassed by the wheel and cowling with the exception of its top and bottom ends, the pocket is indexed ultimately to an exit station diametrically opposed to the entry station, where a further reciprocating push rod proceeds to eject the pack from the wheel, directing it forward into a runout channel along which the operations of folding and sealing the ends of the wrapper will be brought to completion.

It has been found that, when operating speeds are stretched beyond certain limits, wrapping machines of the type in question begin to betray drawbacks that lead to a decided deterioration in quality of the wrapping.

Beyond such operating speed limits, in effect, the centrifugal force and acceleration produced by the indexing movement of the wheel can cause the pack to shift uncontrollably within the relative pocket, resulting in loss of the correct position of the wrapping as it folds around the pack.

It has been observed in particular, that with the pack thrusting against the two overlapping radial flaps folded along its outermost flank, the tubular formation of the wrapping is disturbed.

The ultimate consequence of such movement is that wrappings become substandard, especially from the standpoint of appearance, and instead of hugging the pack closely, are spoilt by creases and kinks, and corners that fail to coincide with the corners of the pack.

The object of the present invention is to embody a wrapping machine in which all the defects of prior art machines as described above can be overcome, in short, a machine capable of enveloping commodities faultessly in close-fitting wrappings even at ultra high operating speeds.

SUMMARY OF THE INVENTION

In a machine for wrapping commodities substantially parallelepiped in shape, of the type comprising a rotatable head with radial pockets that accommodate such commodities singly, each together with a sheet of wrapping material located between the commodity and the pocket, the stated object is realized by using suction clamping means to hold the commodity in position within the pocket during transfer of the pocket from an entry point to an exit point, in such a way as to disallow movement of the commodity internally of the pocket and prevent any relative movement of the commodity and the wrapper.

BRIEF DESCRIPTION OF THE DRAWINGS

The invention will now be described in detail, by way of example, with the aid of the accompanying drawings, in which.

DESCRIPTION OF THE PREFERRED EMBODIMENTS

With reference to the drawings, the numeral 1 denotes a machine for wrapping commodities of parallelepiped shape, in its entirety, and more particularly, a machine designed to envelop packs of cigarettes in sheets of transparent wrapping material.

Figure 1:
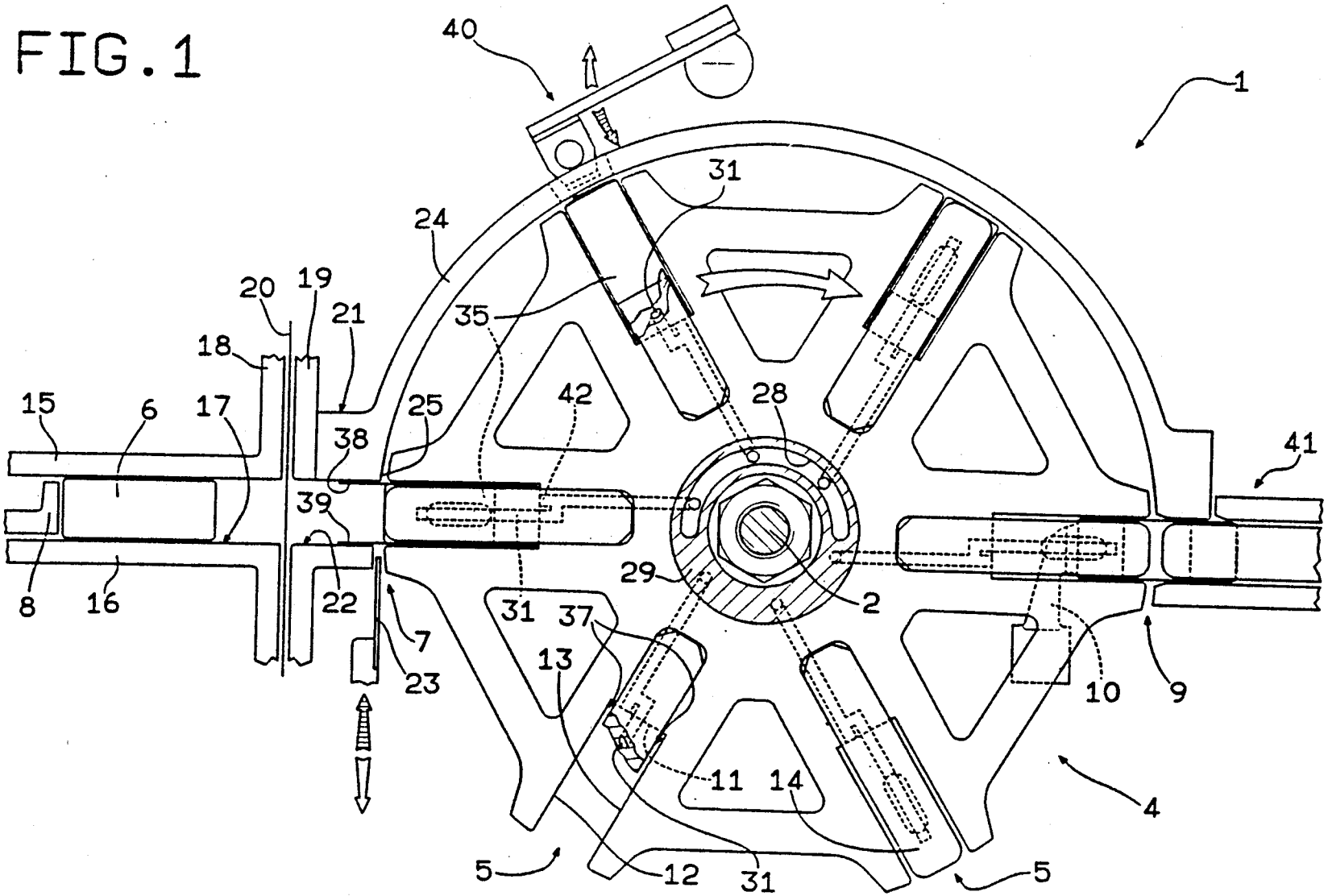
FIG. 1 is the side elevation of a wrapping machine embodied according to the present invention.

The numeral 2 denotes a horizontally disposed shaft affording support by waY of a tubular sleeve 3 to a wrapping head, or wheel 4, provided with six peripheral pockets 5 spaced apart at an angle of 60° one from the next, each designed to accommodate one pack 6 positioned sideways-on to the axis of the shaft. The wheel 4 is set in motion by way of the shaft 2 using conventional means (not illustrated) such as will index it through 60° steps in the clockwise direction as viewed in FIG. 1.

The wheel 4 is placed on the shaft 2 in such a way that with each step indexed, one pocket 5 is moved into an entry station 7, positioned in alignment with a reciprocating push rod 8, and the pocket 5 diametrically opposite is moved simultaneously into an exit station 9 positioned in alignment with a further reciprocating push rod 10.

The single pocket 5 is bounded by a bottom wall 11, nearest the center of the wheel 4, and two walls 12 and 13 occupying planes that coincide substantially with radii of the wheel 4 and are separated by a distance substantially equal to the thickness of one packet of cigarettes 6.

Also associated with each pocket 5 are two tongues denoted 14, establishing two further walls disposed normal to the axis of rotation of the wheel 4 and separated by a distance substantially equal to the longitudinal dimension of the pack 6.

15 and 16 denote two horizontally disposed guide plates aligned with the push rod 8 of the entry station and affording a passage 17 to the incoming pack 6 of cigarettes.

The numerals 18 and 19 denote two vertical guides, positioned at the exit of the passage 17, between which to feed a continuous strip of transparent material that is severed into single wrappers 20 by a conventional cutting device (not illustrated).

The numeral 21 denotes a fold starter located in the path of the push rod 8 between the vertical guides 18 and 19 and the entry station 7, by which a further passage 22 is afforded to the pack 6.

The numeral 23 denotes a folder 23 positioned at the entry station 7, embodied as a vertically disposed vane made to reciprocate through a plane substantially tangential to the wheel 4.

The numeral 24 denotes a cowling, coaxial with the wheel 4 and extending from the entry station 7 to the exit station 9, of which the initial edge 25 serves as a fixed folder, as will become clear in due course.

The numeral 26 denotes a duct of which one end connects with a source of negative pressure 27, and the other with valve means embodied as an arched slot 28 formed in a stationary block 29 coaxial with the shaft 2 and breasted with the sleeve 3.

Each of the single pockets 5 is associated with a pneumatic circuit comprising a duct 30 formed in the sleeve 3 and running parallel with the shaft 2; the duct 30 remains directly open to the slot 28, hence to the negative pressure source 27, during passage of the pocket from the entry station 7 to a position coinciding substantially with the exit station 9.

Each duct 30 relative to a single pocket branches into two substantially radial ducts 31 and 32 which extend through the wheel 4 to terminate, internally of the two tongues 14, in respective vents 33 that are open to the atmosphere and directed into the space encompassed by the pocket 5.

At each pause of the wheel 4, during operation of the machine, the entry push rod 8 is extended in such a way as to direct a pack 6 of cigarettes and a relative wrapper 20 into the pocket 5 currently positioned at the entry station 7.

Passing through the fold starter 21 and into the pocket 5, the wrapper 20 is folded into a U shape around the pack 6, thereby enveloping the leading flank and the top and bottom faces (considered in relation to the direction of entry).

The transverse dimension of the wrapper 20, as considered in relation to the direction of entry, is such that its sides project a given distance beyond the two longitudinal ends of the pack 6. The parts of the wrapper which project beyond the ends of the leading flank of the pack 6 are folded by the tongues 14 as the pack enters the pocket 5, and more exactly, by the ends 34 of the tongues first encountered on entry, in such a way that the two end faces of the pack diposed normal to the axis of the wheel 4 are enveloped in part.

The areas of the two end faces not covered by the wrapper 20 are denoted 35.

The endmost parts of the wrapper extending beyond each end face of the pack 6 thus become a pair of flaps 36 which project from the wheel 4 through respective slits 37 left between the longitudinal edges of each tongue 14 and the pocket wall 12 and 13 on either side.

The longitudinal dimension of the wrapper 20 (as considered in relation to the direction of entry) is such that the ends will project as two radial flaps 38 and 39, respectively top and bottom, from a pocket 5 occupying the entry station 7. The bottom flap 39 is flattened over the rear flank of the pack 6 by a moving folder 23 installed and operating at the entry station 7. The top flap 39 will be flattened by the initial edge 25 of the cowling 24 once the relative pocket 5 is indexed away from the entry station 7 and into a successive station occupied by a heat seal device 40, which approaches the exposed flank of the pack and fuses the overlapping flaps 38 and 39 together.

The pack 6 accommodated by the pocket 5 appears at this point entirely enveloped by the transparent wrapper 20, with the exclusion of the two areas 35 of the end faces aforementioned; following the heat seal, two further indexed steps bring the pack 6 to the exit station 9, where the relative push rod 10 will eject it from the wheel 4 and into a runout 41 along which the procedure of folding and sealing the end flaps 36 will be brought to completion. For as long as the pack 6 remains in the wheel 4, the two open vents 33, connected with the negative pressure source 27 by way of the valve slot 28, will be offered to the areas 35 of the two end faces not enveloped by the wrapper 20.

The pneumatic system provided by the source of negative pressure 27 and the various ducts routed to the vents 33 constitute suction clamping means by way of which to hold the pack 6 securely in the relative pocket 5; such means are comfortably able to offset the effects of centrifugal force and acceleration to which each pack becomes subject during its passage from the entry station 7 to the exit station 9.

The wrapper 20 likewise, held between the pack 6 and the walls 11, 12 and 13 of the pocket 5, is secured indirectly by the suction clamping means thus incorporated.

As illustrated in the drawings, suction means might operate not only on the pack, but also directly on the transparent wrapper 20.

Figure 2:
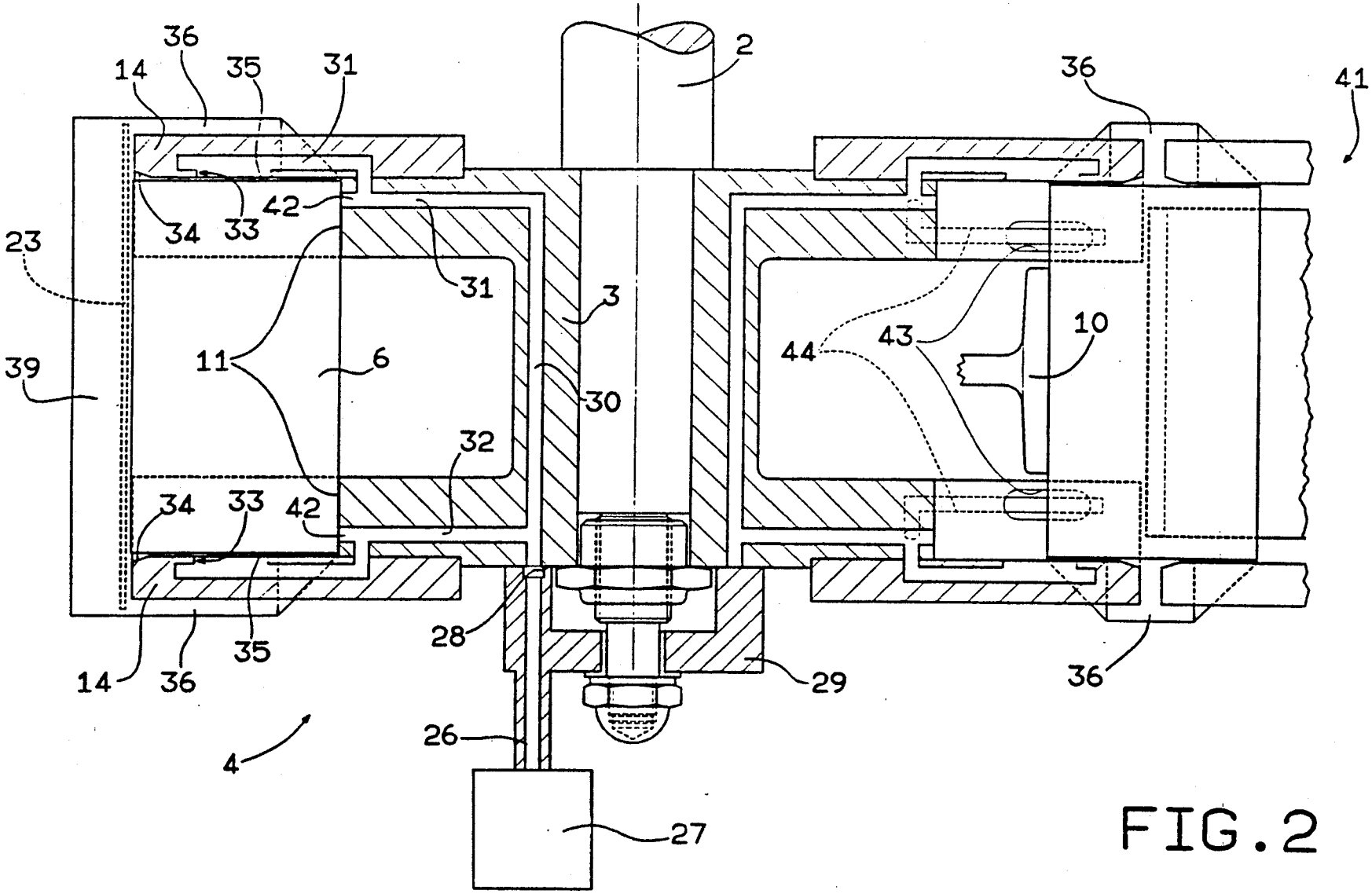
FIG. 2 is a detail of the machine of FIG. 1, seen in section.

By way of example, FIG. 2 shows open vents 42 in the bottom wall 11 of the pocket 5 that are connected directly with the radial ducts 31 and 32.

In a further alternative illustrated in the right hand pocket of FIG. 2, provision is made for two open vents 43 in each of the radial walls of the pocket 5 (the figure shows those of one wall 12 only), each connecting by way of a relative duct 44 with the corresponding radial duct 31 or 32.

By applying suction additionally to the wrapper 20, the clamping action can be made yet more secure, not only in respect of the pack 6 internally of the pocket 5, but also of the wrapper 20 enveloping the relative pack.

What is claimed:

1. A machine for wrapping a succession of substantially parallelepiped commodities, comprising:

a rotatable head, affording a plurality of radial pockets each of which, in use, accommodates a single commodity partially wrapped in a sheet of wrapping material located between the respective commodity and the respective pocket leaving portions of said commodity unwrapped;

respective suction clamping means associated with each said pocket having suction gripping vents for clamping only said unwrapped portions of said commodity in position with the respective pocket during transfer of the respective pocket from a point of entry into said head, to a point of exit from said head, in such a way as to disallow movement of the respective commodity internally of the respective pocket and prevent any relative movement of the respective commodity and the respective sheet of wrapping material.

2. A wrapping machine as in claim 1, wherein:

each said radial pocket is encompassed by a bottom wall, two substantially radial walls and two side walls provided in respective planes which are normal to an axis of rotation of the head;

each said pocket being arranged to accommodate a respective commodity enveloped by a respective sheet of wrapping material with said unwrapped portions being respective areas of two opposite faces of the respective commodity offered parallel to the side walls of the respective pocket;

said suction clamping means comprising a source of negative pressure, a pneumatic circuit associated with each said pocket, valve means by which the circuit is connected to the source during occupation of each pocket by a respective commodity, and said gripping vents being located in the side walls of each pocket, which vents are open to the pneumatic circuit and directed against said areas of said faces not enveloped by the wrapping material.

3. A wrapping machine as in claim 2 wherein:

the pneumatic circuit further comprises at least one open vent located in the bottom wall of each pocket.

4. A wrapping machine as in claim 2, wherein:

the pneumatic circuit further comprises at least one open vent located in at least one of the radial walls of each pocket.

* * * * *